US009590355B2

(12) United States Patent
Kawamura et al.

(10) Patent No.: US 9,590,355 B2
(45) Date of Patent: Mar. 7, 2017

(54) CONNECTOR AND CONNECTOR ASSEMBLY

(71) Applicant: JAPAN AVIATION ELECTRONICS INDUSTRY, LIMITED, Shibuya-ku, Tokyo (JP)

(72) Inventors: Chikara Kawamura, Tokyo (JP); Yukitaka Tanaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/829,985

(22) Filed: Aug. 19, 2015

(65) Prior Publication Data

US 2016/0126672 A1 May 5, 2016

(30) Foreign Application Priority Data

Oct. 29, 2014 (JP) ..... 2014-220606

(51) Int. Cl.
*H01R 13/633* (2006.01)

(52) U.S. Cl.
CPC ..... *H01R 13/633* (2013.01)

(58) Field of Classification Search
USPC ..... 439/153, 352, 357, 358, 345
See application file for complete search history.

(56) References Cited

U.S. PATENT DOCUMENTS

| | | | | |
|---|---|---|---|---|
| 7,281,937 | B2 * | 10/2007 | Reed | H01R 13/6275 439/352 |
| 7,354,292 | B1 * | 4/2008 | Lloyd | H01R 13/6272 439/352 |
| 7,666,023 | B2 * | 2/2010 | Wu | H01R 13/6275 439/352 |
| 7,736,171 | B2 | 6/2010 | Reed et al. | |
| 8,382,506 | B2 | 2/2013 | Reed et al. | |
| 8,562,369 | B2 * | 10/2013 | Wu | H01R 9/032 439/345 |
| 2005/0181670 | A1 * | 8/2005 | Kumamoto | H01R 13/6275 439/358 |
| 2010/0210131 | A1 | 8/2010 | Reed et al. | |

FOREIGN PATENT DOCUMENTS

| | | | |
|---|---|---|---|
| JP | 3121328 | U | 5/2006 |
| JP | 2006228703 | A | 8/2006 |
| JP | 2009123450 | A | 6/2009 |
| JP | 2009543296 | A | 12/2009 |

* cited by examiner

*Primary Examiner* — Alexander Gilman
(74) *Attorney, Agent, or Firm* — Holtz, Holtz & Volek PC

(57) ABSTRACT

A connector is provided with a lock portion, a lock supporting portion and a lock releasing member. A part of the connector forms a fitting portion to be received by a mating fitting portion of a mating connector in a mated state. The lock portion is provided in the fitting portion and locks a mating lock portion in the mated state. The lock supporting portion supports the lock portion to allow movement of the lock portion in a direction intersecting with a fitting direction. The lock releasing member is provided with a pressing portion. When release operation of the lock releasing member is performed, the pressing portion presses a pressed portion to move the lock portion toward an inside of the fitting portion in a perpendicular to the fitting direction.

11 Claims, 15 Drawing Sheets

CONNECTOR AND CONNECTOR ASSEMBLY

CROSS REFERENCE TO RELATED APPLICATIONS

An applicant claims priority under 35 U.S.C. §119 of Japanese Patent Application No. JP2014-220606 filed Oct. 29, 2014.

BACKGROUND OF THE INVENTION

This invention relates to a connector which is mateable with a mating connector and, in particular, to a connector which is provided with a lock mechanism to lock a mated state.

A connector of this type is disclosed in JP 2009-543296 A (Patent Document 1), for example.

As shown in FIG. 26, a plug connector 900 disclosed in Patent Document 1 is mateable with a receptacle connector (not shown) located in an external protection guide frame 950. The plug connector 900 is provided with an actuator 910 and a latch arm 920. The actuator 910 and the latch arm 920 compose a lock mechanism. The actuator 910 has a front end portion 915 that is thick in an upper-lower direction. The latch arm 920 extends over the front end portion 915 of the actuator 910. The latch arm 920 has a hook 925 while an opening portion 955 is formed in the external protection guide frame 950. When the plug connector 900 is mated with the receptacle connector, the hook 925 enters into the opening portion 955 to lock a mated state of the plug connector 900 with the external protection guide frame 950. When the actuator 910 is pulled under the mated state, the latch arm 920 is pushed by the front end portion 915 and is moved upward. Hereby, the hook 925 disengaged from the opening portion 955, and the mated state is released.

In order to function the lock mechanism of Patent Document 1, a space for moving the latch arm 920 is required above the plug connector 900.

Accordingly, in order to function the lock mechanism certainly, it is necessary to direct attention to a usage environment of the connectors, such as a built-in position of the receptacle connector (not shown) or the external protection guide frame 950 in a device in which they are built, a surrounding space of the plug connector 900 in an actual usage environment, and so on. If not, there is a possibility that a space for moving the latch arm 920 cannot be secured so that the lock mechanism does not function.

SUMMARY OF THE INVENTION

It is therefore an object of the present invention to provide a connector with a lock mechanism that locks a mated state where the connector is mated with a mating connector and that functions certainly irrespective of usage environment of the connector.

One aspect of the present invention provides a connector which is mateable with and removable from a mating connector along a fitting direction. The mating connector comprises a mating fitting portion. The mating fitting portion is provided with a mating lock portion. The connector comprises a lock portion, a lock supporting portion and a lock releasing member. The connector has a part which forms a fitting portion to be received by the mating fitting portion in a mated state where the connector is mated with the mating connector. The lock portion is provided in the fitting portion to lock the mating lock portion in the mated state. The lock supporting portion is provided with a pressed portion. The lock supporting portion supports the lock portion to allow movement of the lock portion in a direction intersecting with the fitting direction. The lock releasing member is provided with a pressing portion. The pressing portion presses the pressed portion to move the lock portion toward an inside of the fitting portion in a perpendicular direction perpendicular to the fitting direction when release operation of the lock releasing member is performed.

Another aspect of the present invention provides a connector assembly comprises the connector and the mating connector. In the mated state, the mating lock portion is located between the lock portion and the pressed portion in the fitting direction.

According to the release operation of the lock releasing member, the pressing portion of one aspect of the present invention presses the pressed portion to move the lock portion toward the inside of the fitting portion in the perpendicular direction so that the lock is released. Thus, it is unnecessary to secure a space for moving the lock portion at the outside of the connector. In other words, it is possible to function the lock mechanism as long as there is a space for providing the connector.

An appreciation of the objectives of the present invention and a more complete understanding of its structure may be had by studying the following description of the preferred embodiment and by referring to the accompanying drawings.

Figure 1:
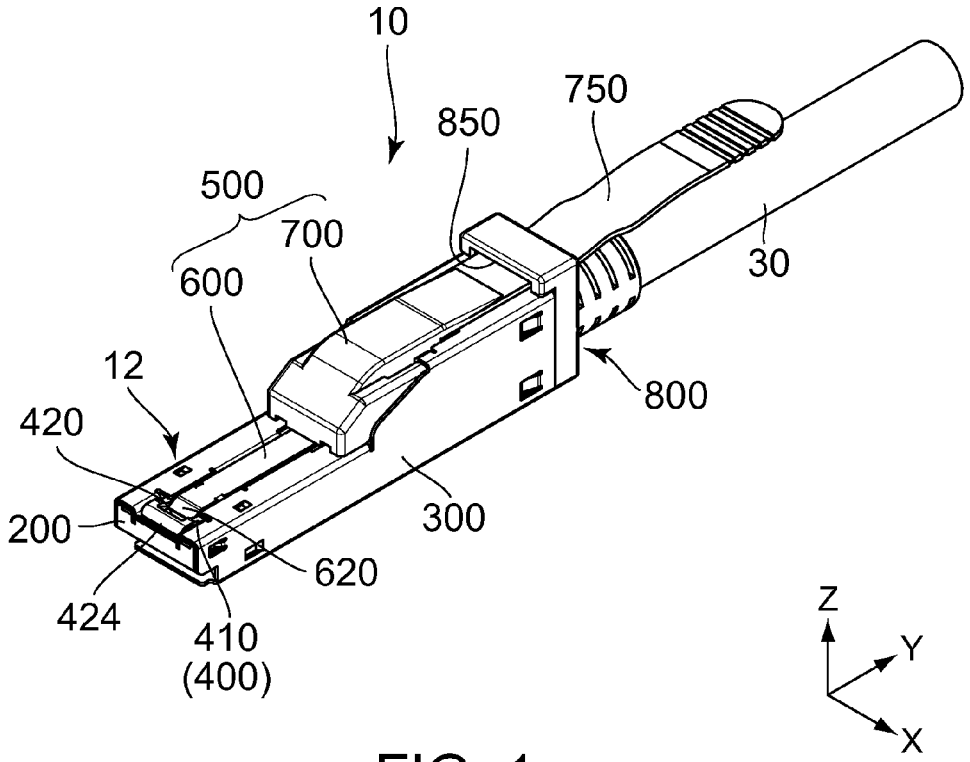
FIG. 1 is a perspective view showing a connector according to an embodiment of the present invention.
Figure 2:
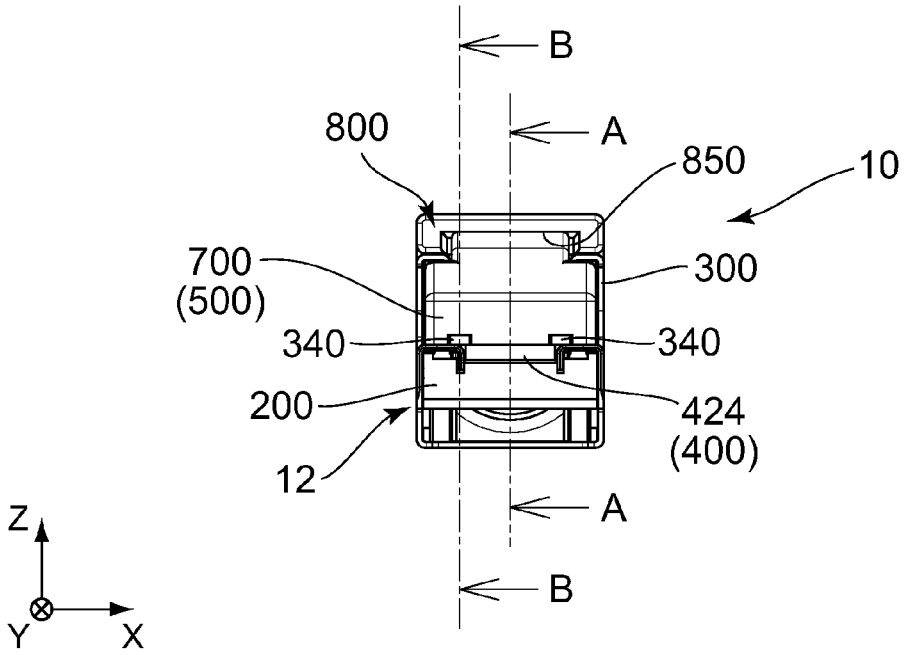
FIG. 2 is a front view showing the connector of FIG. 1.
Figure 3:
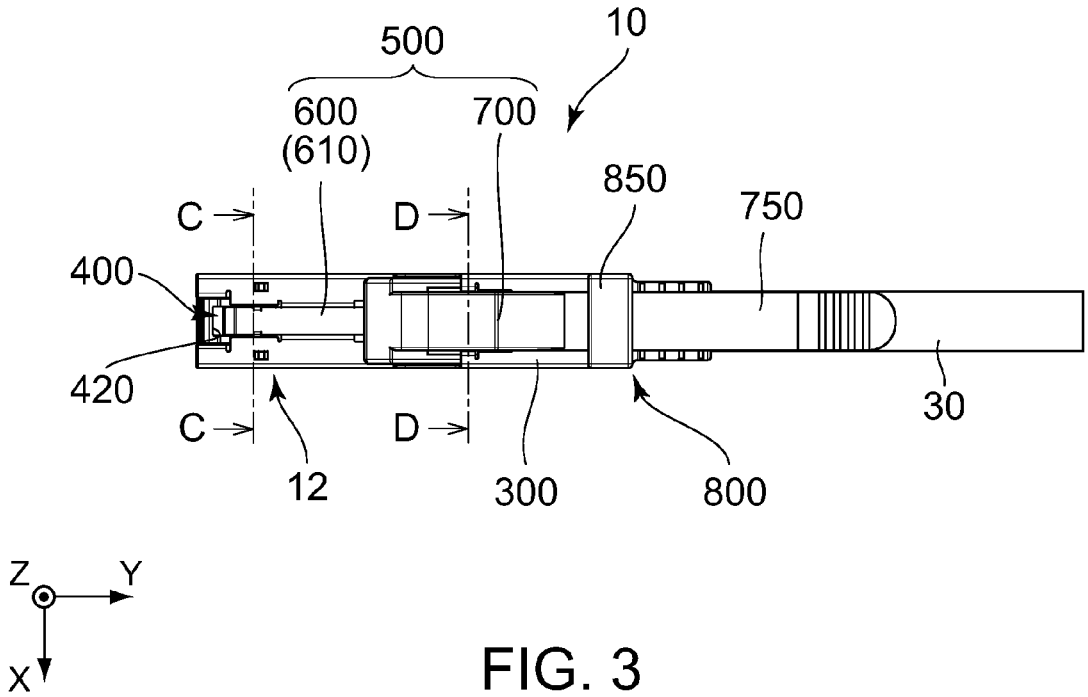
FIG. 3 is a top view showing the connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector 10 according to an embodiment of the present invention is to be connected to a cable 30. As understood from FIGS. 21 to 25, the connector 10 is mateable with a mating connector 50 along a fitting direction (or a front-rear direction or a Y direction). The mating connector 50 is to be built in a device such as a server unit. The connector 10 and the mating connector 50 compose a connector assembly.

Figure 19:
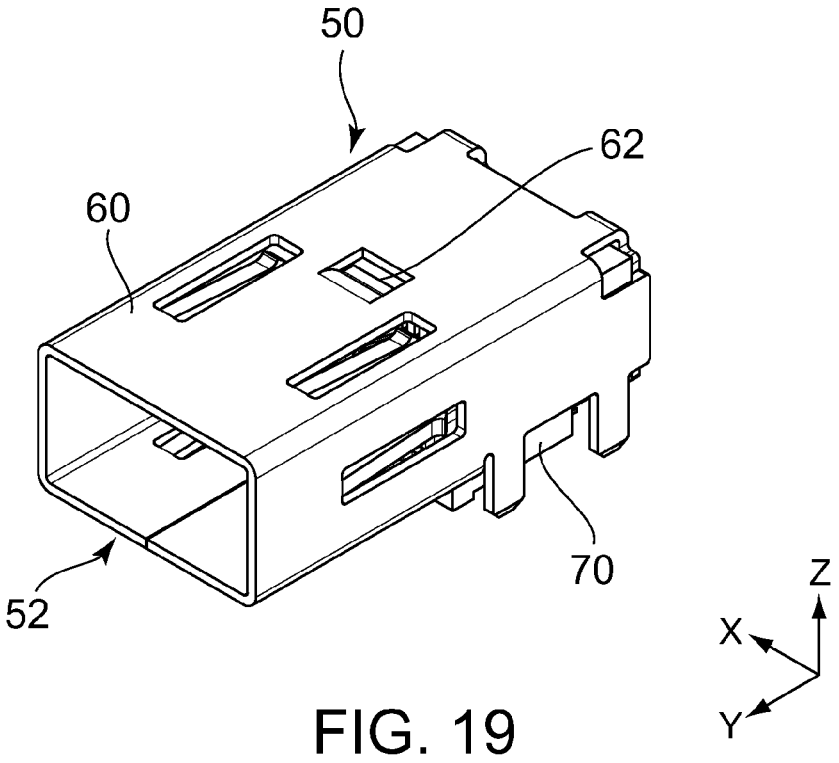
FIG. 19 is a perspective view showing a mating connector according to the embodiment of the present invention.
Figure 20:
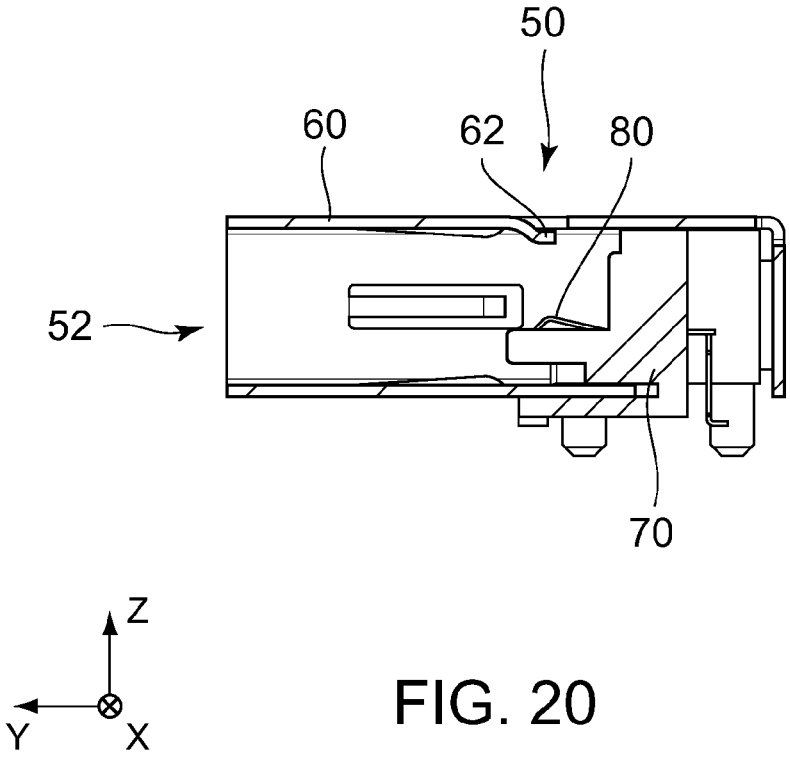
FIG. 20 is a cross-sectional view showing the mating connector of FIG. 19.
Figure 21:
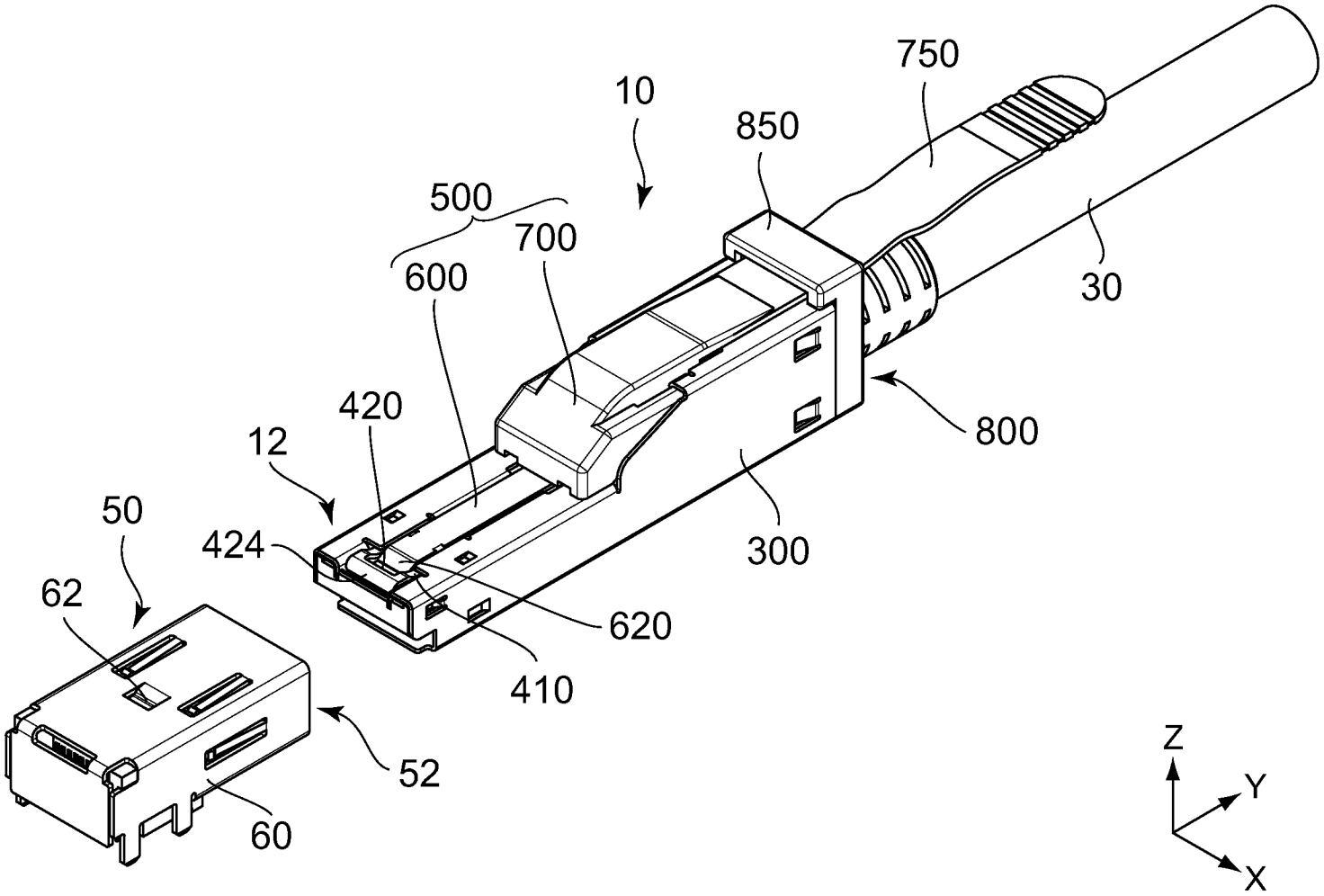
FIG. 21 is a perspective view showing a connector assembly provided with the connector of FIG. 1 and the mating connector of FIG. 19, wherein the connector is not mated with the mating connector.
Figure 22:
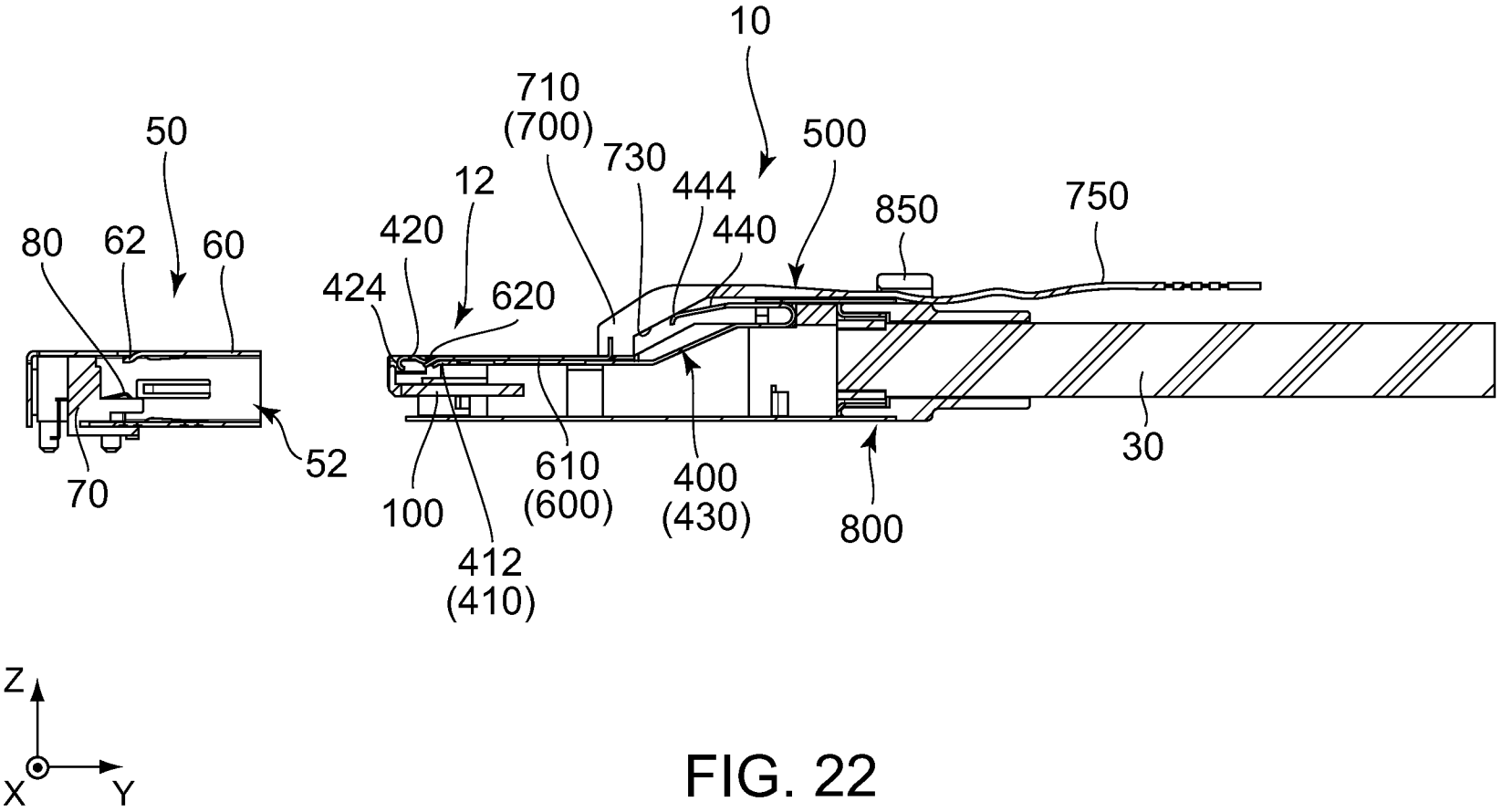
FIG. 22 is a cross-sectional view showing the connector assembly of FIG. 21.
Figure 23:
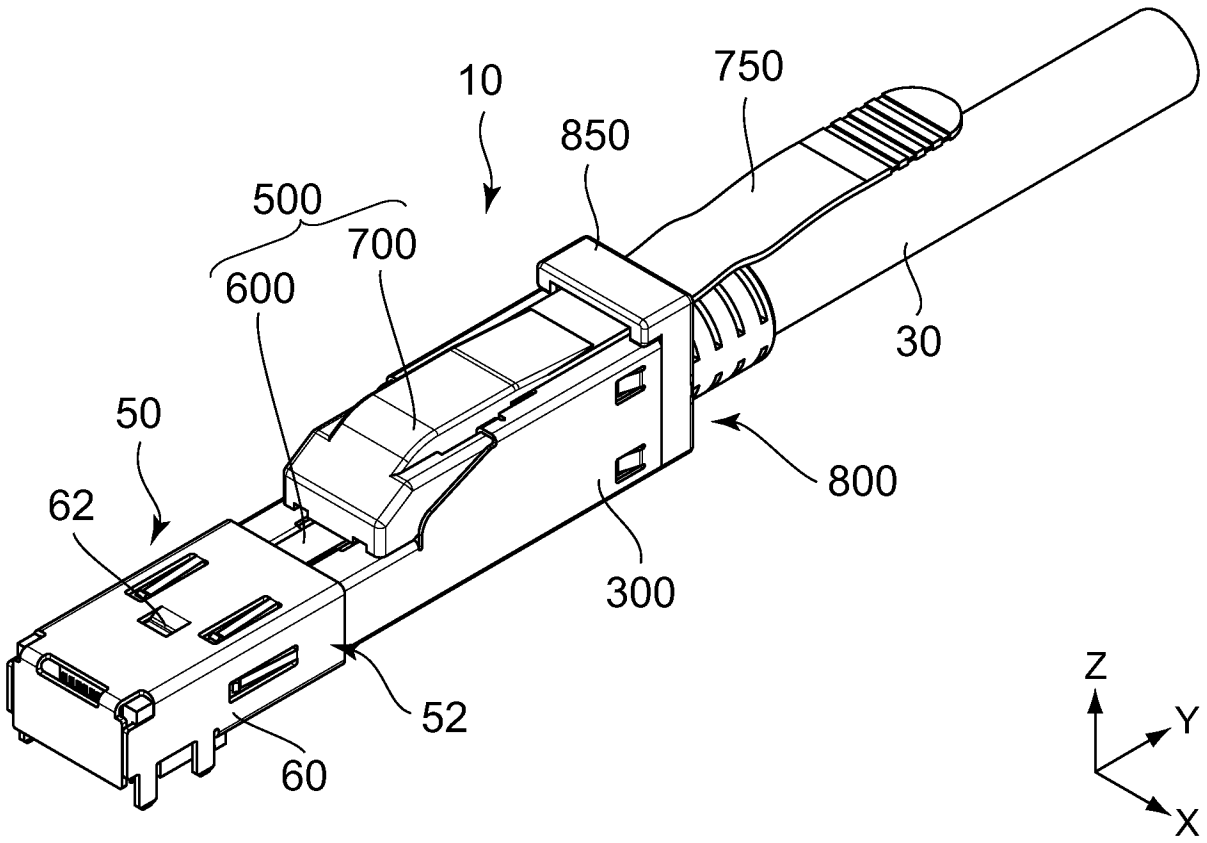
FIG. 23 is another perspective view of the connector assembly of FIG. 21, wherein the connector is mated with the mating connector.
Figure 24:
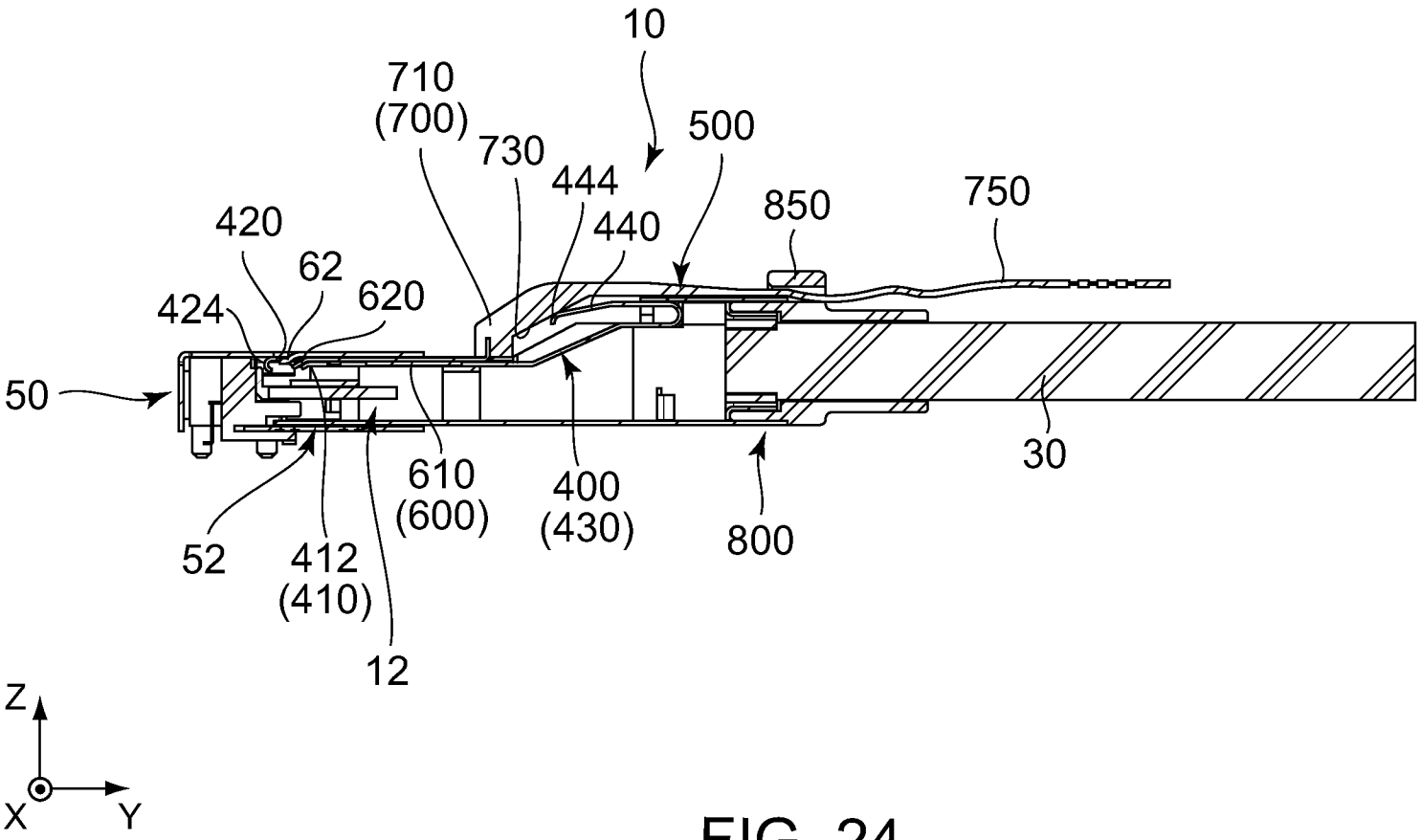
FIG. 24 is a cross-sectional view showing the connector assembly of FIG. 23.
Figure 25:
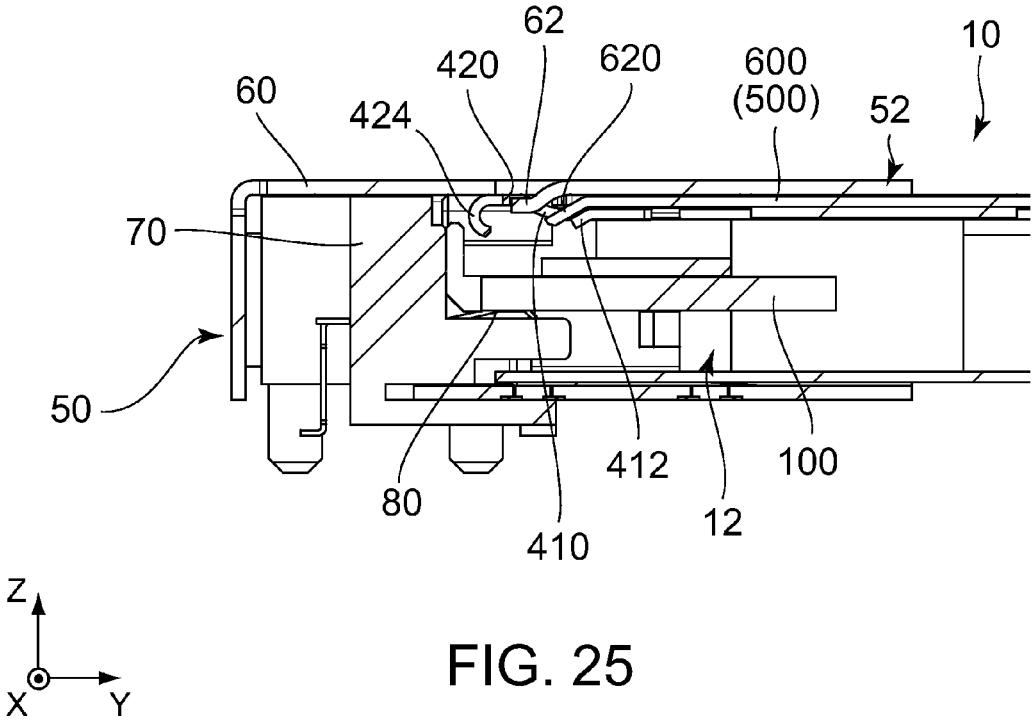
FIG. 25 is an enlarged cross-sectional view showing a fitting portion and a mating fitting portion in the connector assembly of FIG. 24.
Figure 26:
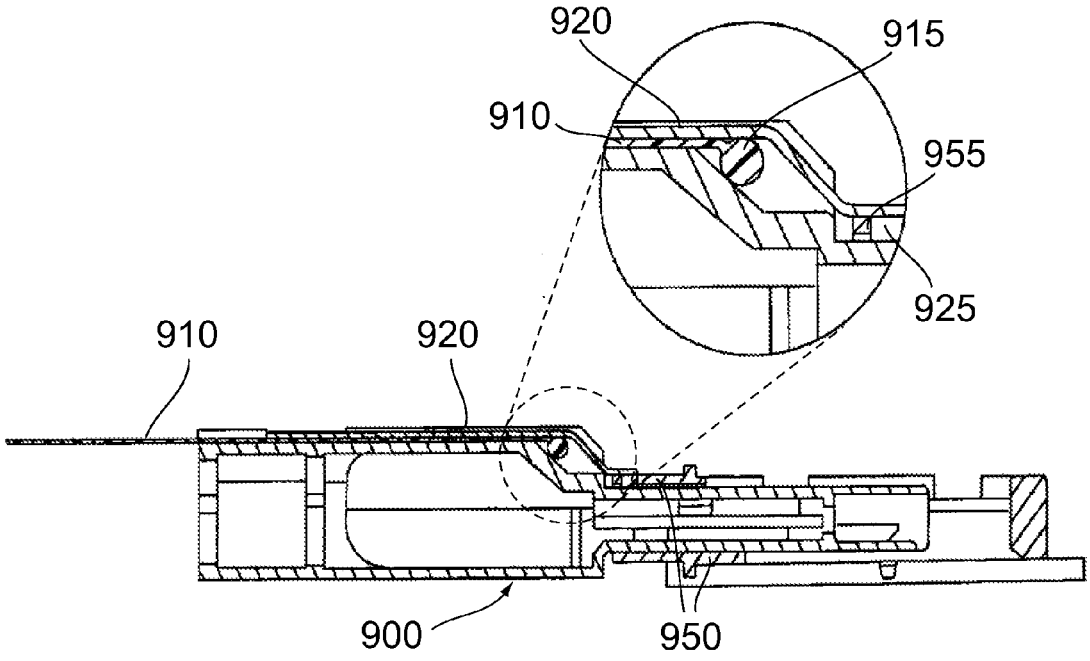
FIG. 26 PRIOR ART
FIG. 26 is a cross-sectional view showing a connector of Patent Document 1.

As shown in FIGS. 21, 22, 24 and 25, the connector 10 has a fitting portion 12 as a part thereof while the mating connector 50 has a mating fitting portion 52 as a part thereof. As understood from FIGS. 1, 21 and 22, the fitting portion 12 of the present embodiment is composed of a front half part of the connector 10. As shown in FIGS. 19, 20 and 22, the mating fitting portion 52 is opened at an end thereof in the fitting direction (i.e. at a positive-Y side end portion). As shown in FIG. 25, in a mated state where the connector 10 is mated with the mating connector 50, the fitting portion 12 is received by the mating fitting portion 52. In other words, the fitting portion 12 is a part of the connector 10 that is received by the mating fitting portion 52 in the mated state.

Referring to FIGS. 19 and 20, the mating connector 50 is provided with a mating shell 60 made of metal, a mating holding member 70 made of insulator and a plurality of mating terminals 80 made of conductor. A part of the mating shell 60 forms an outer profile of the mating fitting portion 52 mentioned above. The mating shell 60 is provided with a mating lock portion 62. The mating lock portion 62 is located inside the mating fitting portion 52 and extends a back away direction from the opening of the mating fitting portion 52.

Referring to FIGS. 1 to 7, the connector 10 is provided with a holding member 200, a shell 300, a lock member 400, a lock releasing member 500 and a cable attaching portion 800.

Figure 12:
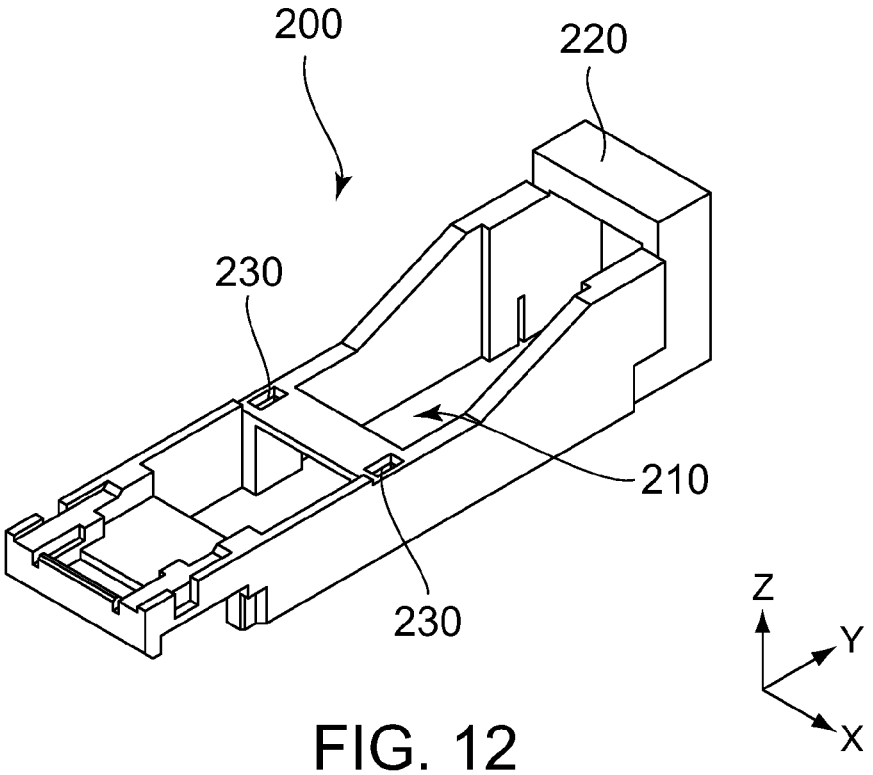
FIG. 12 is a perspective view showing a holding member included in the connector of FIG. 1.

Referring to FIG. 12, the holding member 200 has an accommodation portion 210, a rear wall 220 and pressed-fit portions 230. The holding member 200 is made of insulator. The accommodation portion 210 has a space for accommodating members such as core wires (not shown) included in the cable 30 (see FIG. 1). The rear wall 220 is located at a rear end (or a positive-Y side end part) and an upper end (or a positive-Z side end part) of the holding member 200. The pressed-fit portions 230 are holes formed in walls composing the accommodation portion 210. In the present embodiment, the pressed-fit portions 230 are two.

As shown in FIGS. 4 to 6 and 17, the holding member 200 holds a connecting member 100 when the connector 10 is used. In the present embodiment, the connecting member 100 is a wiring board. The connecting member 100 is connected to the core wires (not shown) of the cable 30 (see FIG. 4). As shown in FIG. 25, the connecting member 100 is electrically connected to the mating terminals 80 in the mated state. The connecting member 100 may be replaced with terminals made of conductor. Meanwhile, in the case where the connecting member 100 is the wiring board, the holding member 200 may be made of other material such as metal.

Figure 4:
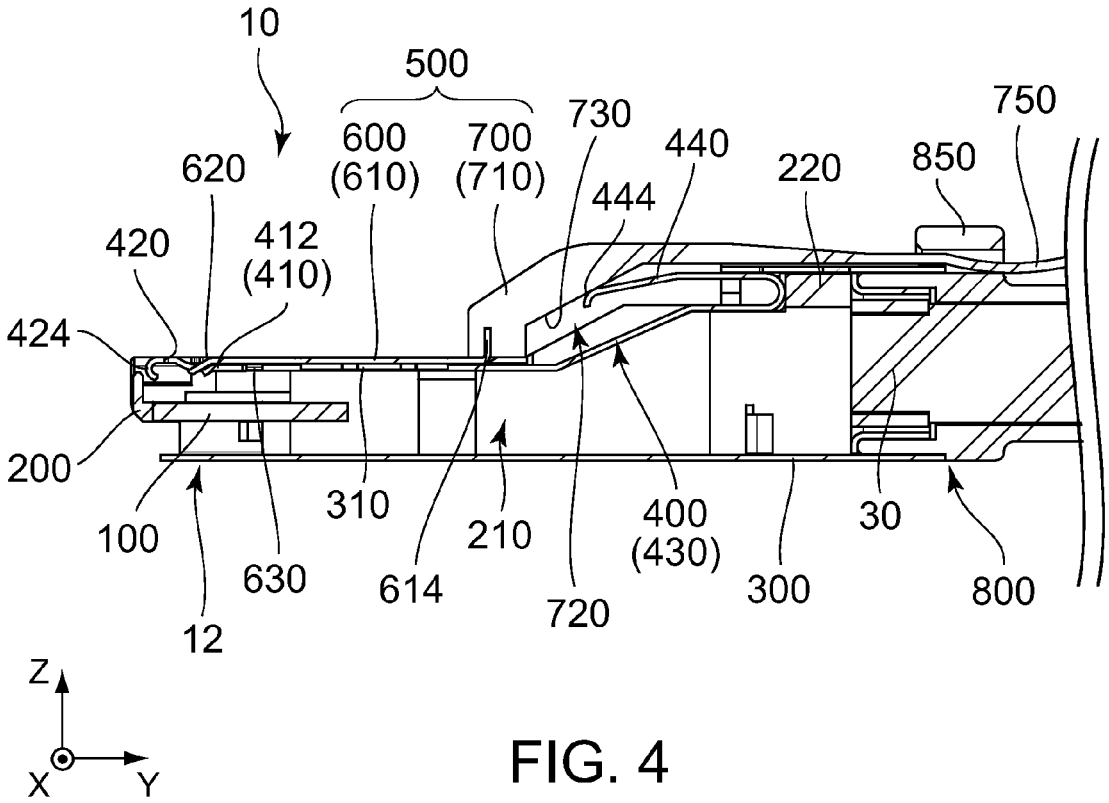
FIG. 4 is a cross-sectional view showing the connector of FIG. 2, taken along line A-A.

As understood from FIGS. 1 and 4, the cable attaching portion 800 attaches the cable 30 to the rear end of the holding member 200 when the connector 10 is used. In the present embodiment, the cable attaching portion 800 consists of plural members and has an operation holding portion 850 as a part thereof. The operation holding portion 850 partly holds the lock releasing member 500.

Figure 11:
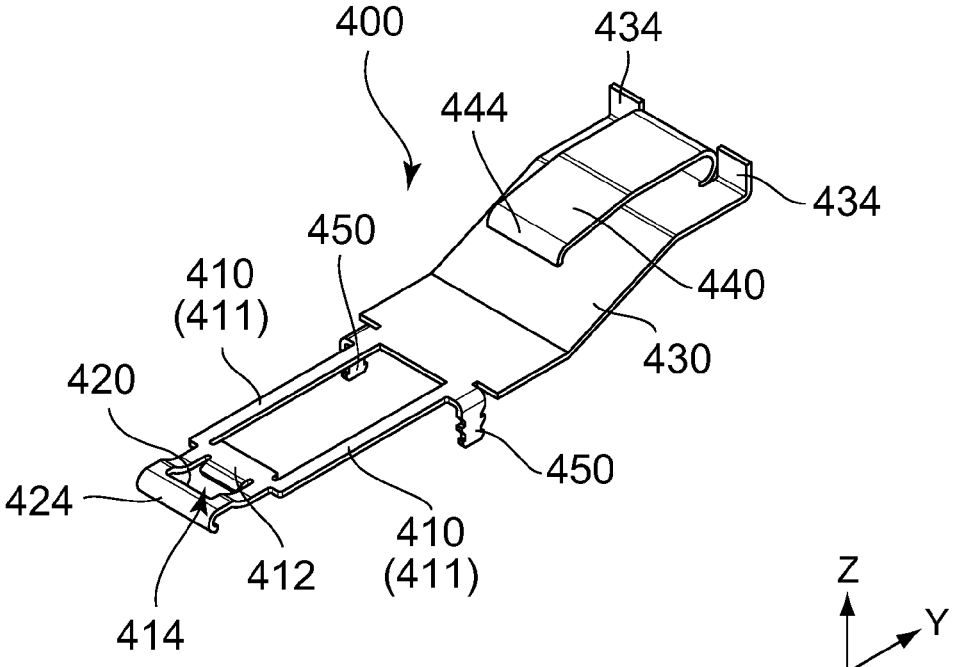
FIG. 11 is a perspective view showing a lock member included in the connector of FIG. 1.

As shown in FIG. 11, the lock member 400 has a lock supporting portion 410, a lock portion 420, a rear main portion 430, a spring portion 440 and press-fit portions 450. The lock member 400 is made of metal. In the present embodiment, the lock supporting portion 410 and the lock portion 420 are formed integrally with each other.

The lock supporting portion 410 has two beam-like portions 411 and a pressed portion 412. The beam-like portions 411 generally extend long in the fitting direction. The pressed portion 412 is located at a little distance from front ends of the beam-like portions 411 to the rear side and couples the beam-like portions 411 in a lateral direction or an X direction. The tip of the pressed portion 412 diagonally extends forward and downward (or in a negative-Y direction and in a negative-Z direction).

The lock portion 420 couples front ends of the beam-like portions 411 of the lock supporting portion 410 in the lateral direction. The lock portion 420 and the pressed portion 412 are apart from each other in the fitting direction so that an opening portion 414 is formed between the lock portion 420 and the pressed portion 412. At a front side of the lock portion 420, a lock guide portion 424 is provided. The lock guide portion 424 has an arc cross-section in a YZ plane or a plane defined by the fitting direction and an upper-lower direction, wherein the upper-lower direction is a perpendicular direction or a Z direction in the present embodiment. The lock guide portion 424 moves the lock portion 420 smoothly when the connector 10 is mated with the mating connector 50 (see FIG. 21).

The rear main portion 430 generally extends rearward from the rear end of the lock supporting portion 410. As understood from FIGS. 11 to 13, the rear main portion 430 partly covers the accommodation portion 210 of the holding member 200. As illustrated in FIG. 11, at the rear end of the rear main portion 430, two raised wall portions 434 are formed to be raised upward.

The spring portion 440 is located between the raised wall portions 434 in the lateral direction and extends frontward from the rear end of the rear main portion 430. The tip of the spring portion 440 is bent downward so that a pushing portion 444 is formed to have a gentle surface.

The press-fit portions 450 are located at the rear end of the lock supporting portion 410 and extends downward. The press-fit portions 450 are provided with press-fit projections. In the present embodiment, the press-fit portions 450 are two and correspond to the pressed-fit portions 230, respectively (see FIG. 12).

Figure 13:
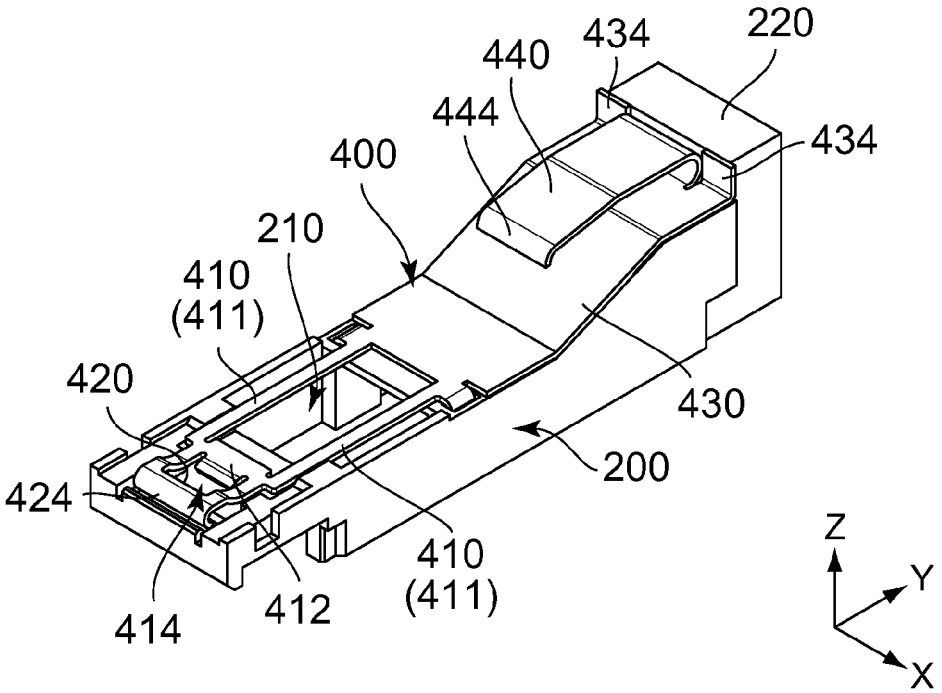
FIG. 13 is a perspective view showing a structure in which the lock member of FIG. 11 is attached to the holding member of FIG. 12.

As understood from FIGS. 11 to 13, by press-fitting the press-fit portions 450 of the lock member 400 into the pressed-fit portions 230 of the holding member 200, the lock member 400 is attached to the holding member 200. Herewith, the lock supporting portion 410 is held by the holding member 200 in a cantilever manner in which the front end of the lock supporting portion 410 is a free end while the rear end of the lock supporting portion 410 is a fixed end. The lock portion 420 is located at the free end of the lock supporting portion 410 and movable in a direction intersecting with the fitting direction. In the present embodiment, the lock portion 420 is movable mainly in the upper-lower direction. Furthermore, the rear main portion 430 covers the part of the accommodation portion 210 while the raised wall portions 434 are located to cover parts of the front surface of the rear wall 220.

Figure 14:
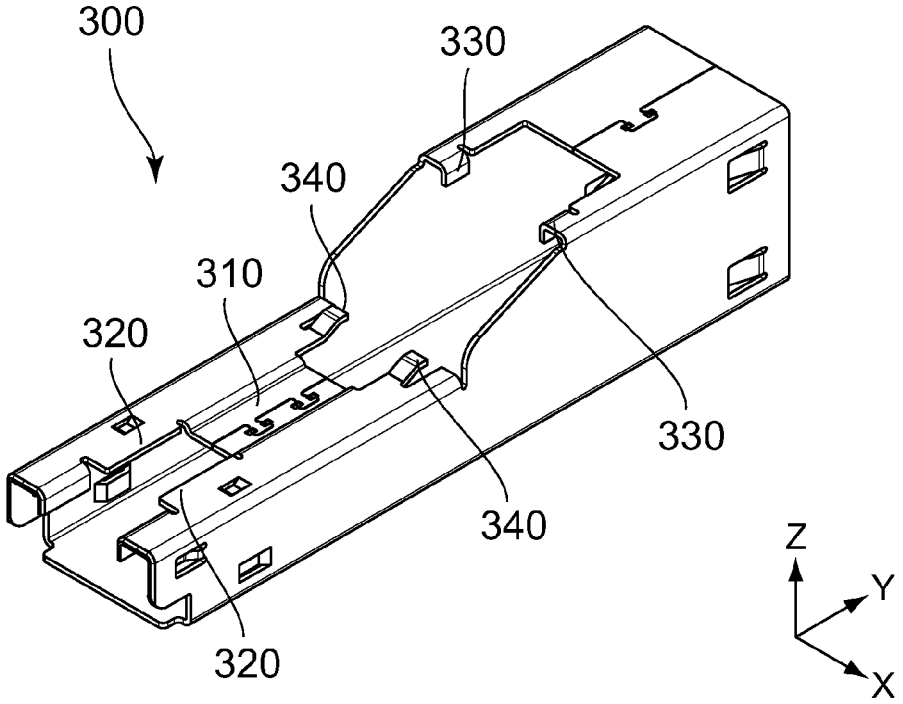
FIG. 14 is a perspective view showing a shell included in the connector of FIG. 1.

Referring to FIG. 14, the shell 300 has a guide portion 310, restricting portions 320, controlling portions 330 and hooks 340. The shell 300 is obtained by punching out and bending a metal sheet. As understood from FIGS. 13, 14 and 18, the shell 300 partly covers the holding member 200. As understood from FIGS. 1, 14 and 18, the front half part of the shell 300 forms an outer profile of the fitting portion 12.

Figure 18:
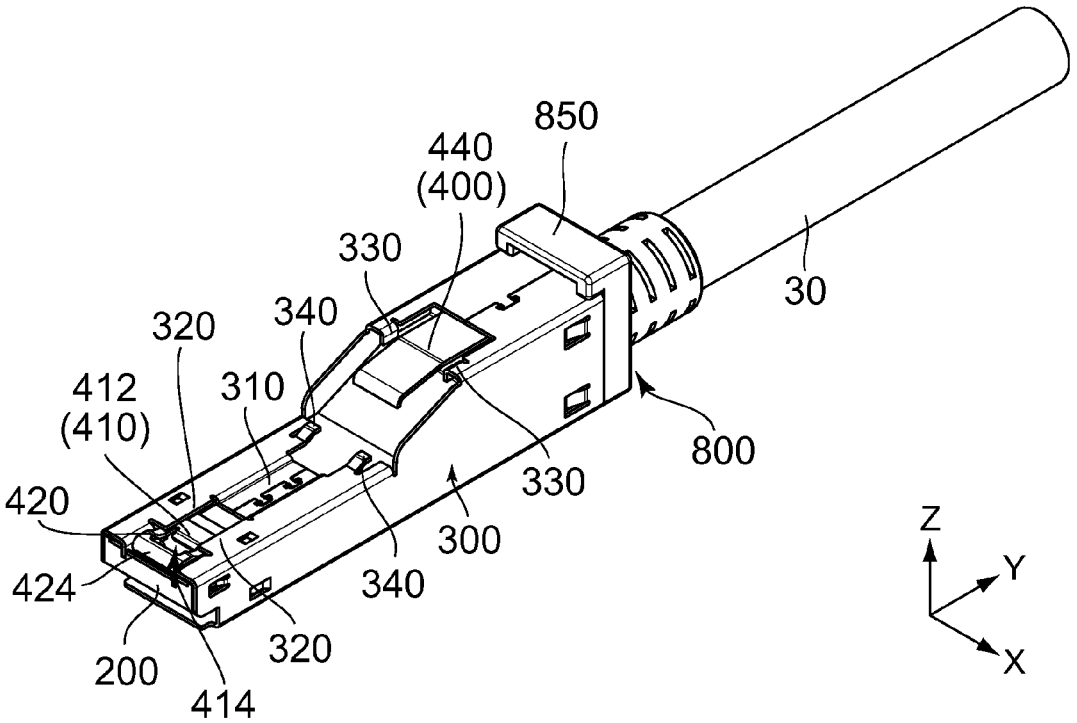
FIG. 18 is a perspective view showing another one step of assembling the connector of FIG. 1.

As shown in FIGS. 14 and 18, the guide portion 310 is formed at the upper portion of the shell 300. As understood from FIGS. 1 and 18, the guide portion 310 is recessed inside from the upper end part of the fitting portion 12 in upper-lower direction. As shown in FIG. 14, the guide portion 310 is located at the center in the lateral direction and extends long in the fitting direction.

As shown in FIGS. 14 and 18, the restricting portions 320 are two. As understood from FIGS. 1 and 18, the restricting portions 320 are included in parts of the upper end part of the fitting portion 12. As shown in FIG. 14, in the present embodiment, the restricting portions 320 are located at a front side or a negative-Y side of the guide portion 310. The two restricting portions 320 are apart from and extend toward each other in the lateral direction.

As shown in FIG. 14, the controlling portions 330 are located at a relatively rear part of the shell 300 and extend toward the inside of the shell 300 in L-shape from upper ends of both side portions of the shell 300.

As understood from FIGS. 1 and 18, the hooks 340 are located rearward of the fitting portion 12. In the present embodiment, the hooks 340 are two. As shown in FIGS. 14 and 18, the hooks 340 are apart from each other in the lateral direction. Furthermore, the hooks 340 extend rearward after diagonally extending rearward and upward.

Figure 15:
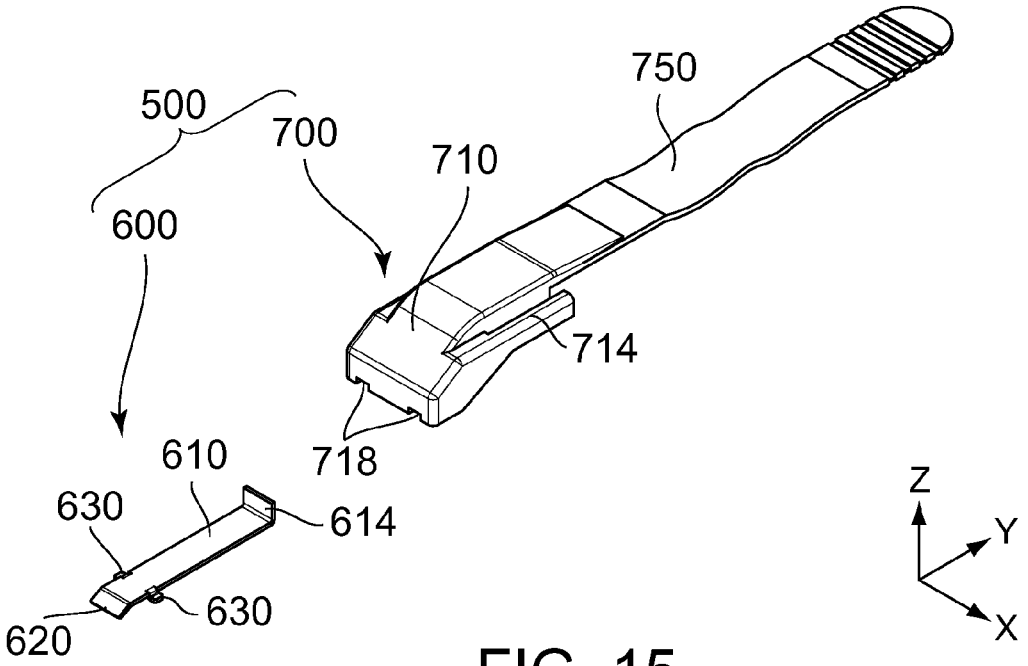
FIG. 15 is an exploded perspective view showing a lock releasing member included in the connector of FIG. 1.
Figure 16:
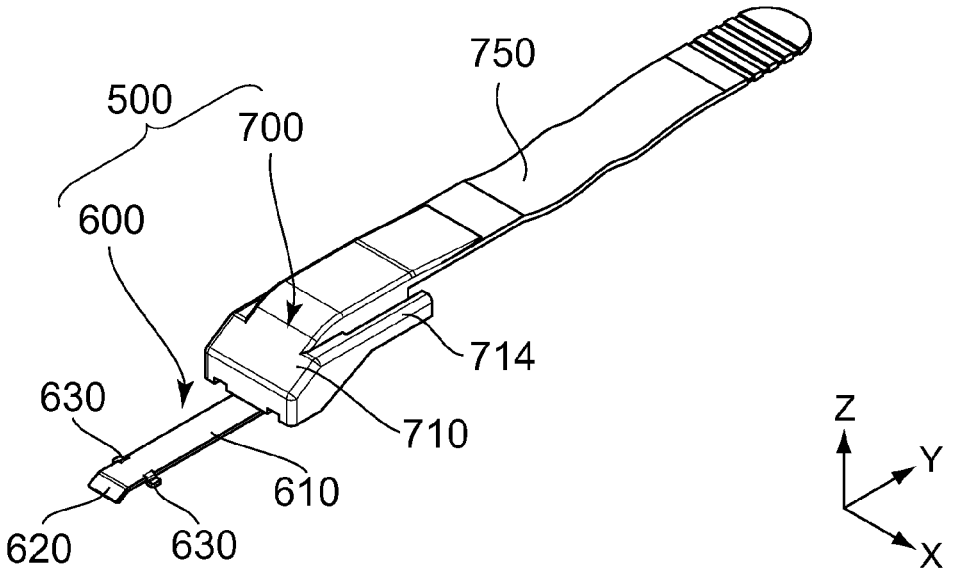
FIG. 16 is a perspective view showing the lock releasing member included in the connector of FIG. 1.
Figure 17:
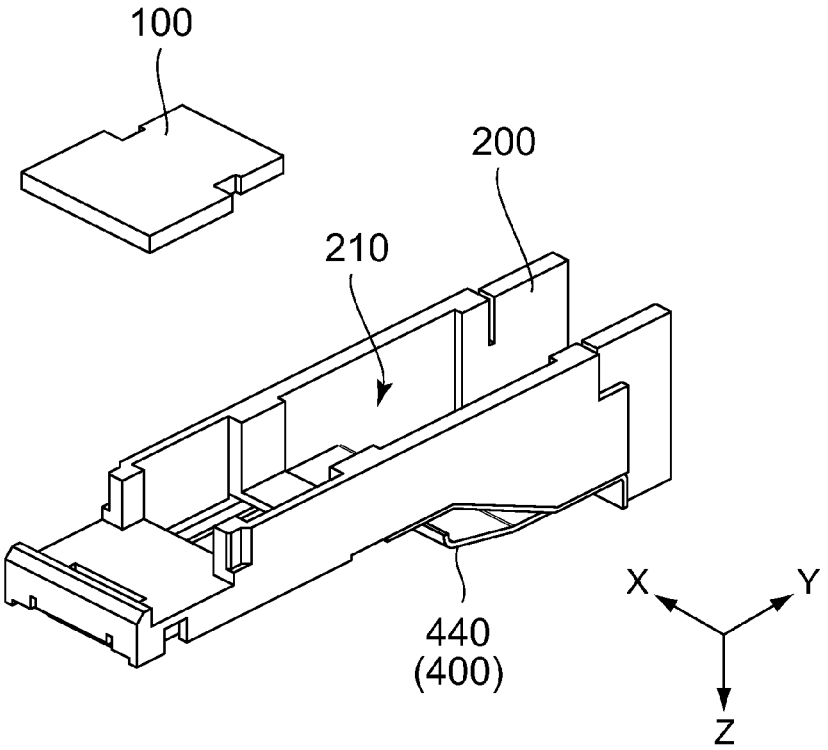
FIG. 17 is a perspective view showing one step of assembling the connector of FIG. 1.

As shown in FIGS. 15 and 16, the lock releasing member 500 of the present embodiment is provided with a releasing portion 600 made of metal and an operation portion 700 made of insulator. The releasing portion 600 may be made of another material. Meanwhile, the lock releasing member 500 may be composed of one piece though it is composed of two pieces in the present embodiment. Furthermore, the lock releasing member 500 may be made of either insulator or metal.

As shown in FIG. 15, the releasing portion 600 has a guided portion 610, a pressing portion 620 and two restricted portions 630. The guided portion 610 generally has a long and narrow platy shape. The rear end 614 of the guided portion 610 extends upward. As understood from FIGS. 4, 15 and 16, the rear end 614 is inserted into and held by the operation portion 700. The pressing portion 620 diagonally extends frontward and downward from the front end of the guided portion 610. The restricted portions 630 extend outward in the lateral direction after extending slightly downward from the guided portion 610. The restricted portions 630 are nearer to the front end of the guided portion 610 than the rear end 614. In other words, in the fitting direction, an interval between each of the restricted portions 630 and the pressing portion 620 is shorter than an interval between each of the restricted portions 630 and the rear end 614.

Figure 7:
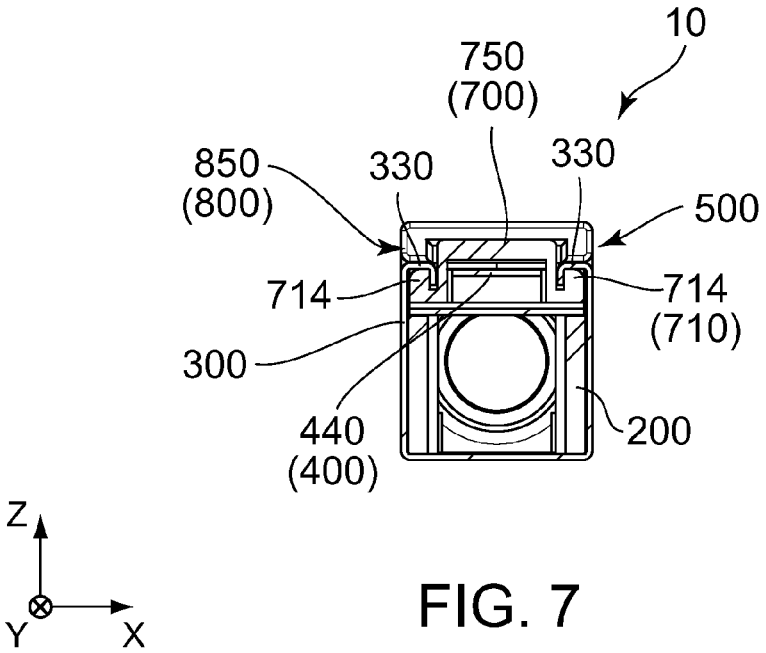
FIG. 7 is a cross-sectional view showing the connector of FIG. 3, taken along line D-D.
Figure 9:
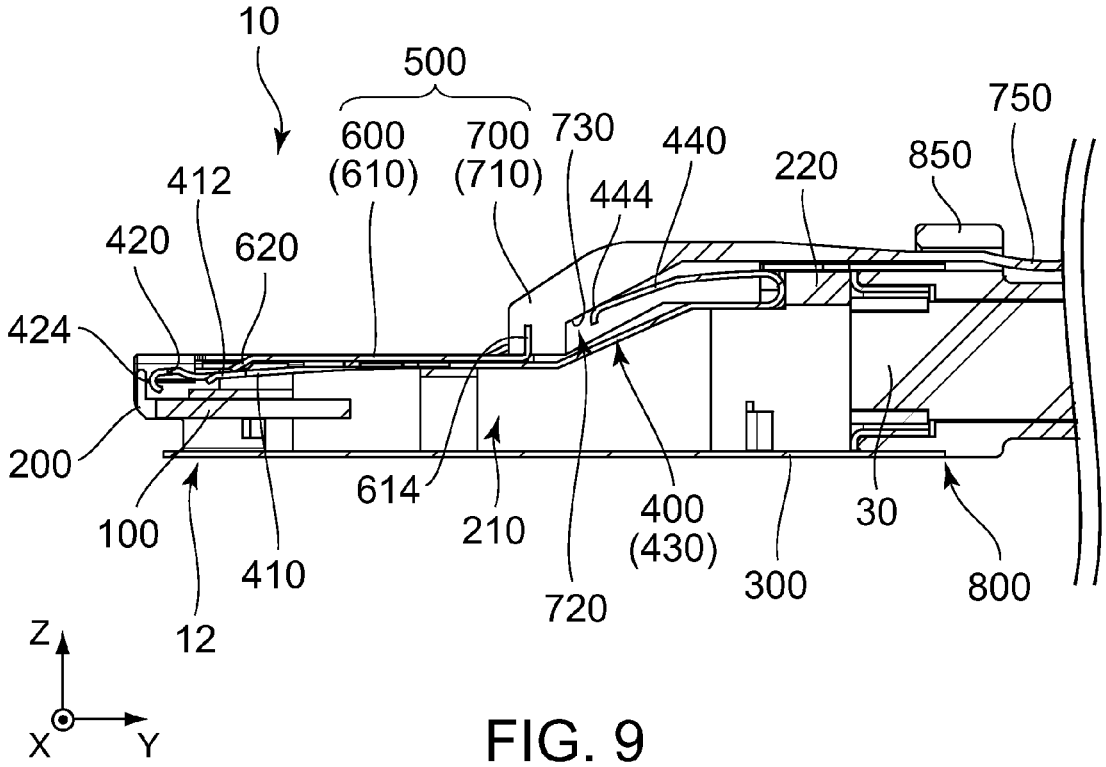
FIG. 9 is a cross-sectional view showing the connector of FIG. 8, corresponding to FIG. 4.

As shown in FIGS. 15 and 16, the operation portion 700 has a head 710 and a pull tab 750 extending rearward from the head 710. As shown in FIGS. 4 and 9, the head 710 is connected with the rear end 614 of the releasing portion 600. As shown in FIGS. 7, 15 and 16, on both sides of the head 710, controlled portions 714 are formed. The controlled portions 714 have a square bar shape elongated in the fitting direction. As understood from FIGS. 5, 10 and 15, two hook accommodation portions 718 are formed at the front end of the head 710 and extend rearward. The rear walls of the hook accommodation portions 718 function as stoppers 719 (as described later). As shown in FIGS. 4 and 9, a spring accommodation portion 720 is formed in the head 710. In the spring accommodation portion 720, a pushed portion 730 is provided. The pushed portion 730 of the present embodiment is composed of an inner wall intersecting with both the fitting direction and the upper-lower direction.

The connector 10 having aforementioned components is fabricated as stated below. At first, as shown in FIG. 13, the lock member 400 is attached to the holding member 200 and, as understood from FIG. 17, the connecting member 100 is built in the holding member 200. Then the cable attaching portion 800 is attached to the holding member 200, and the shell 300 is put on the holding member 200 from the front side of the holding member 200. Thus a structure body shown in FIG. 18 is obtained. In the meantime, as shown in FIGS. 4, 15 and 16, the rear end 614 of the releasing portion 600 is inserted into to the head 710 of the operation portion 700 so that the releasing portion 600 is fixed to the operation portion 700. Thus, the lock releasing member 500 is formed. After that, the lock releasing member 500 shown in FIG. 16 is attached to the structure body shown in FIG. 18. Specifically, 1) the pull tab 750 of the operation portion 700 of the lock releasing member 500 shown in FIG. 16 is inserted into the operation holding portion 850 of the cable attaching portion 800 shown in FIG. 18; 2) the controlled portions 714 shown in FIG. 16 are inserted into the controlling portions 330 shown in FIG. 18; and 3) the restricted portions 630 of the releasing portion 600 of the lock releasing member 500 shown in FIG. 16 are inserted to a lower side of the restricting portions 320 of the shell 300 shown in FIG. 18. Thus, the connector 10 as shown in FIG. 1 is obtained.

As shown in FIGS. 1 and 4, the lock portion 420 is provided in the fitting portion 12 of the connector 10 obtained in this manner. As understood from FIGS. 1, 4 and 13, the lock supporting portion 410 is at least in part provided in the fitting portion 12. As understood from FIGS. 1 and 4 to 6, in the fitting portion 12, the lock portion 420 and the lock supporting portion 410 are located inside the outer profile of the fitting portion 12 in a plane (or an XZ plane) perpendicular to the fitting direction. Similarly, in the fitting portion 12, the releasing portion 600 of the lock releasing member 500 is located inside the outer profile of the fitting portion 12 in the plane perpendicular to the fitting direction. That is, at least in the fitting portion 12, the lock releasing member 500 is located inside the outer profile of the fitting portion 12 in the plane perpendicular to the fitting direction. Thus, the outer profile of the fitting portion 12 of the connector 10 according to the present embodiment is substantially defined by the shape of the shell 300.

As understood from FIGS. 1, 6, 14 and 16, the restricted portions 630 of the releasing portion 600 of the lock releasing member 500 are located under the restricting portions 320 of the shell 300 and movable along the fitting direction. On the other hand, the restricting portions 320 are located outside the restricted portions 630 in the upper-lower direction and regulate outward movement of the restricted portions 630 in the upper-lower direction. Meanwhile, the guided portion 610 of the releasing portion 600 of the lock releasing member 500 is movable on the guide portion 310 along the fitting direction. In other words, the guide portion 310 is located inside the guided portion 610 in the upper-lower direction while supporting the guided portion 610 to regulate inward movement of the guided portion 610 in the upper-lower direction. Furthermore, as understood from FIGS. 1, 7, 16 and 18, the operation holding portion 850 holds the pull tab 750 of the operation portion 700 of the lock releasing member 500 so that the pull tab 750 is movable along the fitting portion. The controlled portions 714 of the operation portion 700 of the lock releasing member 500 are held by the controlling portions 330 of the shell 300 to be movable along the fitting portion. In the meantime, the pull tab 750 is regulated in regard to its upper-lower movement by the operation holding portion 850. Moreover, the controlled portions 714 of the head 710 are regulated in regard to its upper-lower movement by the controlling portions 330. Consequently, by operating the pull tab 750, the operation portion 700 and the releasing portion 600 can be appropriately moved along the fitting direction.

Figure 5:
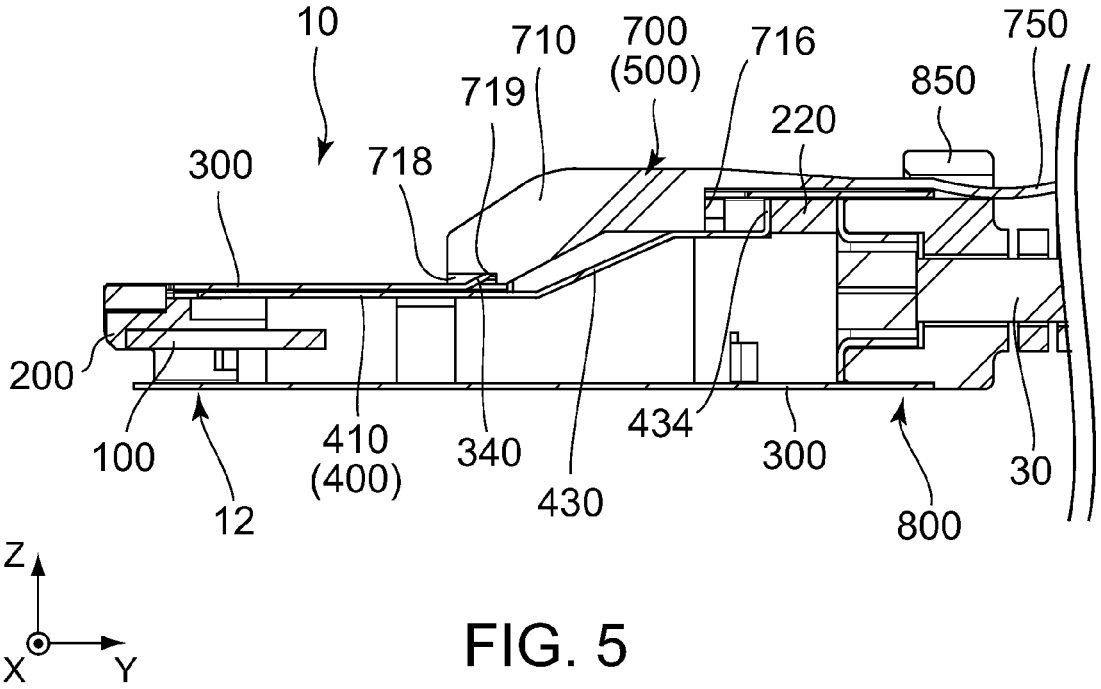
FIG. 5 is a cross-sectional view showing the connector of FIG. 2, taken along line B-B.
Figure 6:
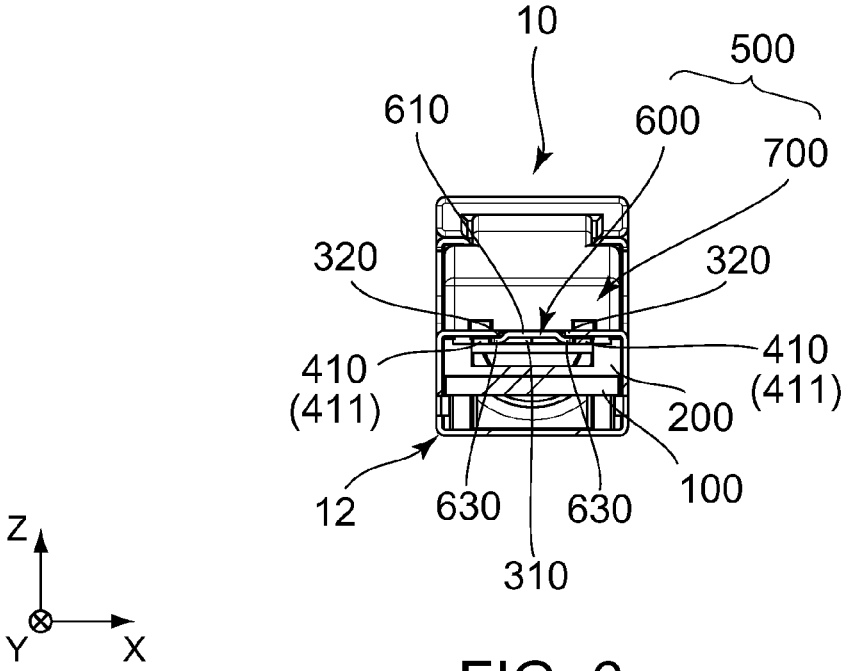
FIG. 6 is a cross-sectional view showing the connector of FIG. 3, taken along line C-C.
Figure 10:
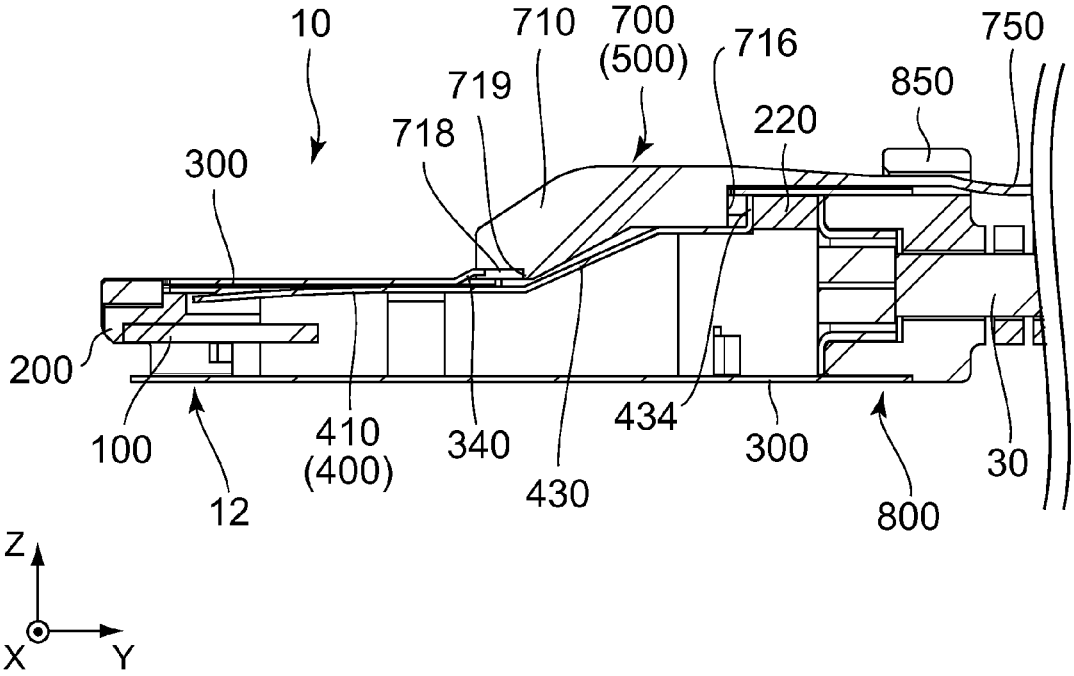
FIG. 10 is a cross-sectional view showing the connector of FIG. 8, corresponding to FIG. 5.

As shown in FIGS. 5 and 10, the hooks 340 of the shell 300 are accommodated in the hook accommodation portions 718 to be relatively movable to the hook accommodation portions 718 in the fitting direction. With this structure, as shown in FIG. 5, when the rear ends of the hooks 340 is brought into abutment with the stoppers 719 in the hook accommodation portions 718, the head 710 of the operation portion 700 cannot go any more toward the front side (or the −Y side). Thus, the hooks 340 and the stoppers 719 define a limit position of the front side of the operation portion 700 (or the lock releasing member 500). It should be noted that, in the present embodiment, the limit position of the front side of the lock releasing member 500 is an initial position of the lock releasing member 500.

Furthermore, as shown in FIGS. 5 and 10, the raised wall portions 434 of the lock member 400 and the rear wall 220 of the holding member 200 are located at a rear side of a head rear end portion 716. Accordingly, the head rear end portion 716 cannot move rearward over the raised wall portions 434. Thus, in the present embodiment, the operation portion 700 or the lock releasing member 500 is movable within a limited range in the front-rear direction. It should be noted that, in the present embodiment, the head rear end portion 716 does not touch the raised wall portions 434 because of existence of the controlled portions 714 (see FIG. 15).

Figure 8:
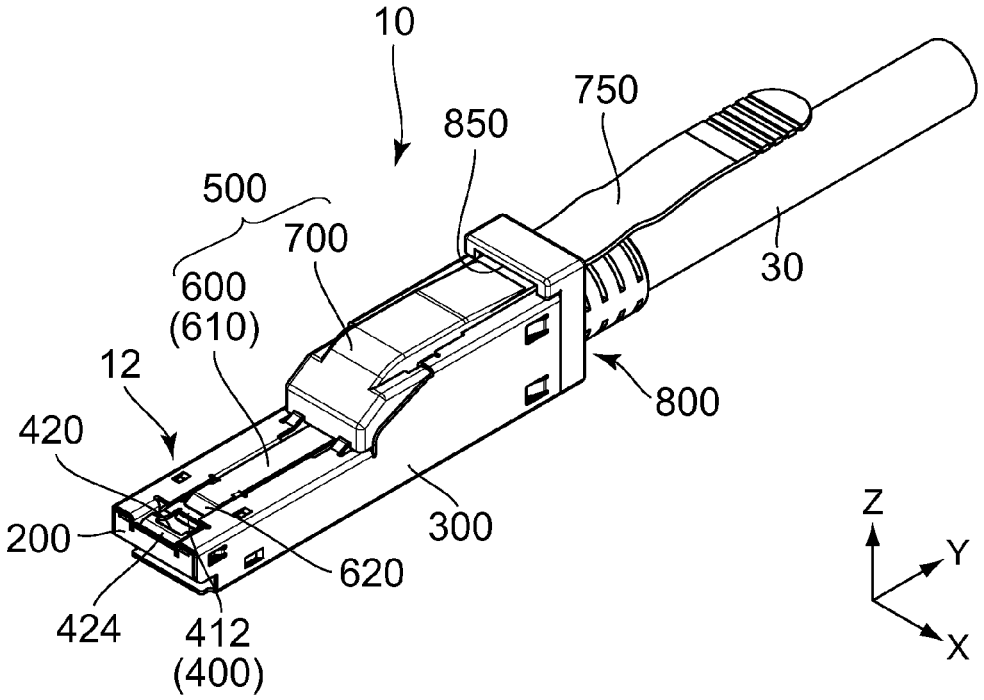
FIG. 8 is another perspective view showing the connector of FIG. 1, wherein the connector is in a state where release operation is performed.

As shown in FIGS. 4 and 9, the spring accommodation portion 720 of the operation portion 700 of the lock releasing member 500 accommodates the spring portion 440 of the lock member 400, and the pushing portion 444 always touches the pushed portion 730. As shown in FIG. 8, when the lock releasing member 500 is moved rearward by pulling the pull tab 750, as shown in FIG. 9, the pushed portion 730 adds a force to the pushing portion 444 to bend the spring portion 440. In this state, when the pull tab 750 is released, the bent spring portion 440 is restored. Upon the restoration of the spring portion 440, the pushing portion 444 pushes the pushed portion 730. In addition, the lock releasing member 500 is regulated in regard to its upper-lower movement as mentioned above. Therefore, when pushing the pushed portion 730, the pushing portion 444 moves the lock releasing member 500 forward and returns the lock releasing member 500 to its initial position.

As understood from FIGS. 1, 4, 11, 13 and 16, when the lock releasing member 500 is located at the initial position, the pressing portion 620 of the lock releasing member 500 is located inside the opening portion 414 of the lock member 400. That is, the pressing portion 620 is located at between the lock portion 420 and the pressed portion 412 in the fitting direction. In this state, as shown in FIGS. 8 to 10, when the release operation is performed so that the operation portion 700 of the lock releasing member 500 is moved rearward, as shown in FIG. 9, the pressing portion 620 of the releasing portion 600 of the lock releasing member 500 presses the pressed portion 412 of the lock supporting portion 410 to move the lock portion 420 inside the fitting portion 12 in the upper-lower direction. More specifically, when the release operation of the lock releasing member 500 is performed, the lock portion 420 is moved toward the inside of the shell 300. When the operation of the operation portion 700 is stopped, the lock releasing member 500 is returned to the initial position by the force of the spring portion 440, and the pressing portion 620 of the lock releasing member 500 is returned in the opening portion 414 of the lock member 400.

As understood from FIGS. 21 and 22, when the connector 10 is mated with the mating connector 50 by inserting the fitting portion 12 of the connector 10 into the mating fitting portion 52 of the mating connector 50, the lock guide portion 424 is brought into abutment with the mating lock portion 62, and the lock portion 420 is temporarily pushed down to the inside of the fitting portion 12. The lock portion 420 is moved beyond the mating lock portion 62 in the fitting direction, so that the lock portion 420 is returned to the original position by the restoring force of the lock supporting portion 410. As a result, in the mated state shown in FIGS. 23 and 24, as shown in FIG. 25, the mating lock portion 62 is located at between the lock portion 420 and the pressed portion 412 in the fitting portion. In the mated state, even if the connector 10 is tried to be pulled out, the lock portion 420 is brought into abutment with the mating lock portion 62 to lock the mating lock portion 62. Consequently, the mated state is maintained. On the other hand, when the operation portion 700 is pulled to perform the release operation, as shown in FIG. 9, the pressing portion 620 presses the pressed portion 412, and the lock portion 420 is moved toward the inside of the fitting portion 12. By this movement, the lock of the mating lock portion 62 by the lock portion 420 shown in FIG. 25 is released. Thus, the connector 10 can be pulled out. In the present embodiment, the direction for the release operation and the direction for pulling the connector 10 out from the mating connector 50 are the same as each other. Therefore, it is possible to smoothly carry out a series of operations from the release operation to the removal operation of the connector 10.

As understood from the aforementioned mating operation and removal operation, the lock portion 420 never projects out of the fitting portion 12. Accordingly, it is unnecessary to secure an unnecessary space around the connector 10 or the mating connector 50 in consideration of a space for moving the lock portion 420 when size and shape of the mating connector 50 is decided or when the mating connector 50 is built in the device.

Although the specific explanation about the present invention is made above referring to the embodiments, the present invention is not limited thereto.

Although the restricting portions 320 in the aforementioned embodiment are always located outside the restricted portions 630 in the upper-lower direction, the present invention is not limited thereto. For example, the restricting portions 320 may not be located outside the restricted portions 630 as long as they are located outside the restricted portions 630 in the upper-lower direction at least during the release operation (specifically, while the pressing portion 620 moves the pressed portion 412 to the inside of the fitting portion 12), and they regulate the outward movement of the restricted portions 630 in the upper-lower direction.

Although the shell 300 in the aforementioned embodiment forms the outer profile of the fitting portion 12, the present invention is not limited thereto. For example, the connector 10 may not have the shell 300. In such a case, the holding member 200 may be modified to form the outer profile of the fitting portion 12.

Although, in the aforementioned embodiment, "perpendicular direction perpendicular to the fitting direction" has been described as the upper-lower direction, the present invention is not limited thereto. For example, the lateral direction may be the perpendicular direction.

The present application is based on a Japanese patent application of JP2014-220606 filed before the Japan Patent Office on Oct. 29, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with and removable from a mating connector along a fitting direction, wherein:

the mating connector comprises a mating fitting portion;

the mating fitting portion is provided with a mating lock portion;

the connector comprises a lock portion, a lock supporting portion and a lock releasing member;

the connector has a part which forms a fitting portion to be received by the mating fitting portion in a mated state where the connector is mated with the mating connector;

the lock portion is provided inside the fitting portion to lock the mating lock portion in the mated state;

the lock supporting portion is provided with a pressed portion;

the lock supporting portion supports the lock portion to allow movement of the lock portion in a direction intersecting with the fitting direction;

the lock releasing member is provided with a pressing portion; and the pressing portion presses the pressed portion to move the lock portion toward an inside of the fitting portion in a perpendicular direction perpendicular to the fitting direction when a release operation of the lock releasing member is performed.

2. The connector as recited in claim 1, wherein:

the connector further comprises a holding member and a shell covering, at least in part, the holding member;

the shell has a part which forms an outer profile of the fitting portion; and the lock portion is moved toward an inside of the shell when the release operation of the lock releasing member is performed.

3. The connector as recited in claim 2, wherein:

the lock supporting portion and the lock portion are formed integrally;

the lock supporting portion is held by the holding member in a cantilever manner in which one end of the lock supporting portion is a free end; and the lock portion is provided at the free end of the lock supporting portion.

4. The connector as recited in claim 2, wherein:

the lock releasing member is provided with a restricted portion;

the shell is provided with a restricting portion; and at least during the release operation, the restricting portion is located outside the restricted portion in the perpendicular direction and regulates outward movement of the restricted portion in the perpendicular direction.

5. The connector as recited in claim 2, wherein:

the lock releasing member is provided with a guided portion;

the shell is provided with a guide portion;

the guide portion is located inside the guided portion in the perpendicular direction; and the guide portion supports the guided portion and restricts movement of the guided portion toward the inside in the perpendicular direction.

6. The connector as recited in claim 2, wherein, in the fitting portion, the lock portion and the lock supporting portion are located inside the outer profile of the fitting portion in a plane perpendicular to the fitting direction.

7. The connector as recited in claim 2, wherein, at least in the fitting portion, the lock releasing member is located inside the outer profile of the fitting portion in a plane perpendicular to the fitting direction.

8. The connector as recited in claim 2, wherein:

the connector further has an operation holding portion; and the operation holding portion holds the lock releasing member to allow the lock releasing member to move along the fitting direction.

9. The connector as recited in claim 8, wherein:

the lock releasing member is provided with a controlled portion:

the shell is provided with a controlling portion; and the controlling portion allows the controlled portion to be moved toward the fitting direction while controlling the controlled portion to regulate outward movement of the controlling portion in the perpendicular direction.

10. The connector as recited in claim 1, wherein:

the lock releasing member comprises a releasing portion and an operation portion connected to the releasing portion:

the pressing portion is provided in the releasing portion; and the pressing portion of the releasing portion presses the pressed portion of the lock supporting portion when the operation portion is operated along the fitting direction.

11. A connector assembly comprising the connector recited in claim 1 and the mating connector, wherein, in the mated state, the mating lock portion is located between the lock portion and the pressed portion in the fitting direction.

* * * * *